US007441652B2

(12) United States Patent
Armstrong et al.

(10) Patent No.: US 7,441,652 B2
(45) Date of Patent: Oct. 28, 2008

(54) MIXING SYSTEM

(75) Inventors: William D. Armstrong, West Lafayette, IN (US); Richard B. Sisken, West Lafayette, IN (US)

(73) Assignee: Med Institute, Inc., West Lafayette, IN (US)

( * ) Notice: Subject to any disclaimer, the term of this patent is extended or adjusted under 35 U.S.C. 154(b) by 583 days.

(21) Appl. No.: 11/131,121

(22) Filed: May 17, 2005

(65) Prior Publication Data

US 2005/0281132 A1 Dec. 22, 2005

Related U.S. Application Data

(60) Provisional application No. 60/572,853, filed on May 20, 2004.

(51) Int. Cl.
*B65D 25/08* (2006.01)
*B01F 13/00* (2006.01)
*B01F 15/02* (2006.01)

(52) U.S. Cl. ..... 206/221; 366/130; 366/189; 366/275

(58) Field of Classification Search ..... 222/219, 222/222; 366/139, 130, 275, 189; 206/221
See application file for complete search history.

(56) References Cited

U.S. PATENT DOCUMENTS 4,381,776 A * 5/1983 Latham, Jr. ..... 604/317
4,458,733 A * 7/1984 Lyons ..... 366/129
4,467,588 A * 8/1984 Carveth ..... 206/219
4,589,879 A * 5/1986 Pearson ..... 604/88
4,645,073 A * 2/1987 Homan ..... 206/219
4,932,937 A * 6/1990 Gustavsson et al. ..... 604/87
4,982,769 A * 1/1991 Fournier et al. ..... 206/222
5,100,241 A * 3/1992 Chan ..... 366/139
5,102,408 A * 4/1992 Hamacher ..... 604/416
5,431,174 A * 7/1995 Knute ..... 604/407
5,569,225 A * 10/1996 Fleury ..... 604/323
5,709,467 A * 1/1998 Galliano, II ..... 366/130
5,876,116 A 3/1999 Barker et al.
5,881,536 A * 3/1999 Muller-Wille et al. ..... 53/426
5,951,160 A * 9/1999 Ronk ..... 366/130
5,961,210 A * 10/1999 McCardel et al. ..... 366/130
5,961,211 A 10/1999 Barker et al.
6,024,480 A 2/2000 Seaton et al.
6,033,105 A 3/2000 Barker et al.
6,352,585 B1 * 3/2002 Diesso ..... 106/35
6,435,705 B1 * 8/2002 Long ..... 366/139
6,572,256 B2 * 6/2003 Seaton et al. ..... 366/139
6,648,133 B1 * 11/2003 Blaschke et al. ..... 206/221
6,796,701 B2 * 9/2004 Wahlig et al. ..... 366/139
7,198,150 B1 * 4/2007 Blaschke et al. ..... 206/221
2005/0281132 A1 * 12/2005 Armstrong et al. ..... 366/139

* cited by examiner

*Primary Examiner*—Tony G Soohoo
(74) *Attorney, Agent, or Firm*—Brinks Hofer Gilson & Lione

(57) ABSTRACT

A mixing system and method for forming bone cement by mixing liquid monomer methyl methacrylate (MMA) with a powder component comprising polymethyl methacrylate (PMMA). A container of MMA is received in a bag. The MMA is emptied from the container into the bag, and a syringe is connected to the bag in substantially leak-free manner to receive the MMA from the bag. The syringe is disconnected from the bag and thereafter connected to a receptacle housing the powder component. The MMA is then transferred into the receptacle in substantially leak-free manner.

14 Claims, 3 Drawing Sheets

MIXING SYSTEM

RELATED APPLICATION

The present patent document claims the benefit of the filing date under 35 U.S.C. §119(e) of Provisional U.S. Patent Application Ser. No. 60/572,853, filed May 20, 2004, which is hereby incorporated by reference.

BACKGROUND

1. Technical Field

The present application relates to a system for mixing hazardous materials, and more particularly, to a closed system for mixing hazardous materials such as bone cement.

2. Background Information

Many substances in common use in industry and other fields are known to have toxic and/or noxious properties. To the extent possible, efforts are generally made to attempt to minimize human exposure to such substances. However, appropriate standards are not always available to evaluate the extent to which such substances may be safely used. In addition, accurate means to determine the amount of the substance in a defined space are not always available. Over-exposure to hazardous substances can have severe health consequences to the exposed person. It can also result in legal consequences to a manufacturer and/or seller of such substances, as well as to an employer of the exposed person. Thus, there is an ongoing need for improved techniques and apparatus to minimize unnecessary exposure to hazardous substances.

One substance known to be hazardous to living organisms is the liquid monomer methyl methacrylate. Methyl methacrylate is in widespread use in industry, and particularly in the medical and dental industries, where it is a component of bone cement. Methyl methacrylate is highly volatile and flammable, and is intended for use only in areas provided with adequate air circulation and ventilation. Excessive exposure to this liquid monomer has been implicated in conditions such as contact dermatitis, asthma, drowsiness, headaches, anorexia, sexual disorders, decrease in gastric motor activity, and irritation of the respiratory tract and eyes, among other conditions. Particularly severe conditions that have been reported include pregnancy complications, and disorders of the liver. Accordingly, many products containing methyl methacrylate, such as bone cements, are regulated in the United States by the Food and Drug Administration, and in numerous other countries by the appropriate regulatory bodies.

Bone cement is generally sold as two separately packaged components. One of the components is a liquid, and the other component is a powder. The liquid component primarily comprises the liquid monomer methyl methacrylate (MMA), and may also include a polymerization inhibitor, such as hydroquinone, and an accelerator, such as dimethyl paratoluidine. The powder component primarily comprises polymethyl methacrylate (PMMA), and may also include an initiator for the polymerization reaction of MMA to PMMA, such as dibenzoyl peroxide, and a radiopaque substance, such as barium sulfate, to assist in the identification of the bone cement under fluoroscopy.

During preparation of bone cement, the liquid component is mixed with the powder component. During this reaction, harmful methyl methacrylate vapors are released. Attempts have been made to minimize the effect of these vapors, such as performing the transfer in an exhaust hood, or in a closed system such as a vacuum. Although these techniques are preferable to carrying out the mixing operation in an open room environment, the techniques are not without shortcomings. For example, each technique necessitates that the transfer take place in a room that is specially equipped with the necessary equipment, such as an exhaust hood or a vacuum generator. Although the use of an exhaust hood can eliminate a high percentage of the vapors, exhaust hoods have varying degrees of reliability, and some vapors can nevertheless escape. Even small amounts of released vapors in a room environment can adversely affect sensitive persons. The use of a vacuum is generally effective in controlling such vapors, however vacuum apparatus can be complicated and difficult to operate.

Accordingly, it is desired to provide a system for mixing hazardous substances, such as bone cement, that minimizes excessive exposure to the hazardous substances. In addition, it is desired to provide a system that utilizes readily accessible components, is easy to operate, and is inexpensive.

BRIEF SUMMARY

The problems of the prior art are addressed by providing a mixing system for hazardous substances, such as methyl methacrylate.

In one form thereof, the invention comprises a mixing system for mixing a hazardous substance with one or more additional components to form a product. The mixing system comprises a bag sized for receiving a container of the hazardous substance, and for housing the hazardous substance in a substantially leak-free manner. A conduit having a connector is provided to mate with a connector on the bag to form a substantially leak-free seal. The conduit is sized and adapted to receive the hazardous substance from the bag. A receptacle is provided having a connector configured to mate with the conduit connector to form a substantially leak-free seal. The receptacle is sized for housing the one or more additional components, and for receiving the hazardous substance from the conduit for mixing with the one or more additional components to form the product.

In another form thereof, the invention comprises a mixing system for mixing a hazardous substance with one or more additional components to form a product. The mixing system comprises a bag having a connector, wherein the bag is sized for receiving a container of the hazardous substance therein. A receptacle having a connector configured to mate with the bag connector is provided for receiving the hazardous substance from the bag. The receptacle is sized for housing the one or more additional components therein and for receiving the hazardous substance to form the product.

In still another form thereof, the invention comprises a method for mixing a hazardous substance with one or more additional components to form a product. A mixing system comprising a bag and a receptacle is provided. The bag contains the hazardous substance, and the receptacle contains the one or more additional components. The hazardous substance is transferred to the receptacle in a substantially leak-free manner. The hazardous substance is then mixed with the one or more additional components to form the product. When the product to be formed comprises bone cement, the hazardous substance comprises methyl methacrylate (MMA), and the one or more additional components comprises polymethyl methacrylate (PMMA). The MMA may be added directly to the receptacle, or may initially be transferred added to a conduit, such as a syringe, and transferred therefrom to the receptacle.

DETAILED DESCRIPTION OF THE DRAWINGS AND THE PRESENTLY PREFERRED EMBODIMENTS

Figure 1:
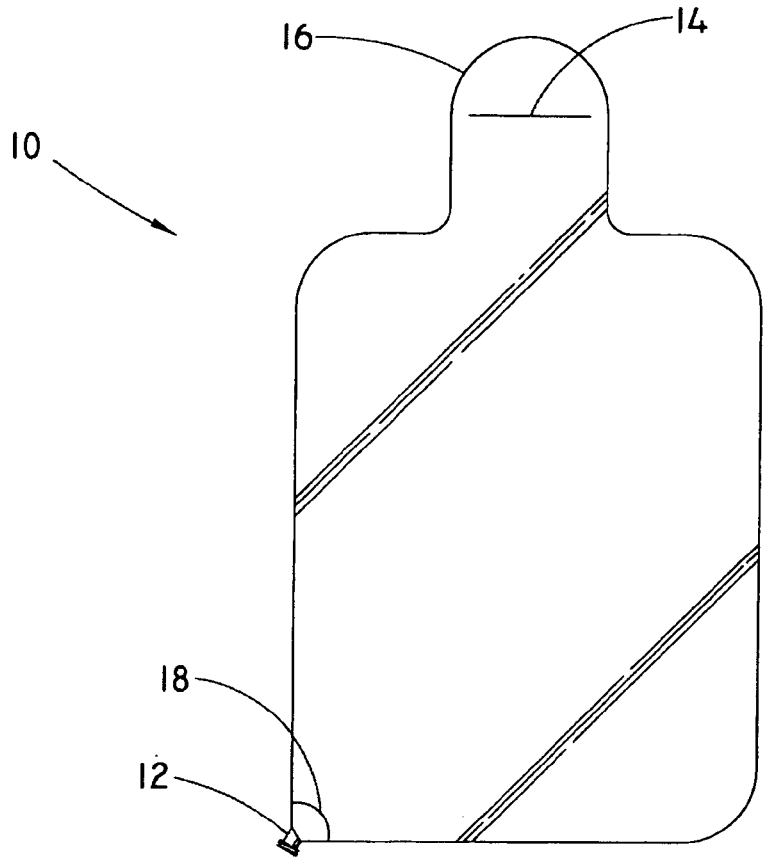
FIG. 1 is a front view of a transfer bag for use in the inventive mixing system.

For the purposes of promoting an understanding of the principles of the invention, reference will now be made to the embodiments illustrated in the drawings, and specific language will be used to describe the same. It should nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIG. 1 illustrates a front view of one embodiment of a transfer bag 10 of the inventive mixing system. Although referred to herein for convenience as a "bag", it is understood that this term is intended to include any type of carrier or receptacle of any shape or configuration that would be recognized by those of ordinary skill in the art as being appropriate for the purposes described herein.

Transfer bag 10 is utilized for housing a hazardous substance, prior to transfer of that substance to a separate container for mixing with one or more other substances. Transfer bag 10 is formed from a flexible material, such as a plastic or rubber, that is generally non-reactive to the hazardous substance to be housed therein. Preferably, bag 10 is formed from a flexible, substantially transparent polymeric material of the type commonly utilized in the formation of utility bags, such as polyethylene, polyimide, silicone, polyester, polyetherimide, PVC, polyurethane, nylon, and various copolymers thereof.

Bag 10 includes a sealable opening 14 for insertion of the hazardous substance. In a preferred embodiment, opening 14 is provided on an extended portion 16 of bag 10, as shown in FIG. 1. In this embodiment, opening 14 comprises a slit, preferably a horizontal slit, that is sealable by conventional means. Conventional sealing mechanisms that may be appropriate in a particular case include, among others, a "rib and groove" fastener having extruded interlocking profile fasteners such as a ZIPLOC®-type seal, a hook and loop seal such as a VELCRO® seal, a zipper, and an adhesive. Those skilled in the art will appreciate that other sealing mechanisms may be substituted. It is important that the selected sealing mechanism be adequate to prevent the substantial escape of vapors from the interior of the transfer bag, and not otherwise interfere with or contaminate the hazardous substance contained inside the bag.

Although many different seals are possible, the rib and groove fastener is particularly preferred due to ease in manufacture, and the ability to extrude the sealing elements from the same material that is used to form the bag. The principle of engagement of such fasteners is the interlocking of mating longitudinal features on opposing sides of the opening. By forming the head of the rib to be wider than the neck of the groove, a snapping engagement can be established between the elements. This provides an effective seal, as well as a seal that can be easily disengaged when desired.

Bag 10 need not have the general shape shown in FIG. 1, and may be formed to have any shape, such as a square or rectangular shape, that is appropriate for its intended use. Similarly, bag 10 may be formed to have any length and height appropriate for its intended use. The thickness of the walls of bag 10 will be dependent upon the nature of the particular hazardous substance to be housed therein, and on the manner by which the hazardous substance is to be introduced into the bag. Those skilled in the art can easily determine appropriate dimensions for bag 10 based upon the composition of bag 10, as well as the amount and identity of the hazardous substance to be deposited therein.

In the embodiment shown, bag 10 includes a connector 12, such as a male luer lock connector. Connector 12 is sized and shaped to mate with a corresponding connector of a conduit. This connection enables the leak-free transfer of the hazardous contents of bag 10 to the conduit. Preferably, a filter mechanism 18 is provided at or near connector 12 to filter out broken glass particles or other solids prior to transfer of the contents of the bag to the conduit. Filter 18 may be formed of metal, polymers or other well-known mesh filter composition. The mesh of the filter can be sized and shaped in accordance with the anticipated size of solid particles in the bag. Suitable connectors, including but not limited to the luer connector described herein, are well known and need not be further discussed. Suitable luer connectors are normally injection molded. If desired, the filter material may be insert molded into the connector in known fashion.

Figure 3:
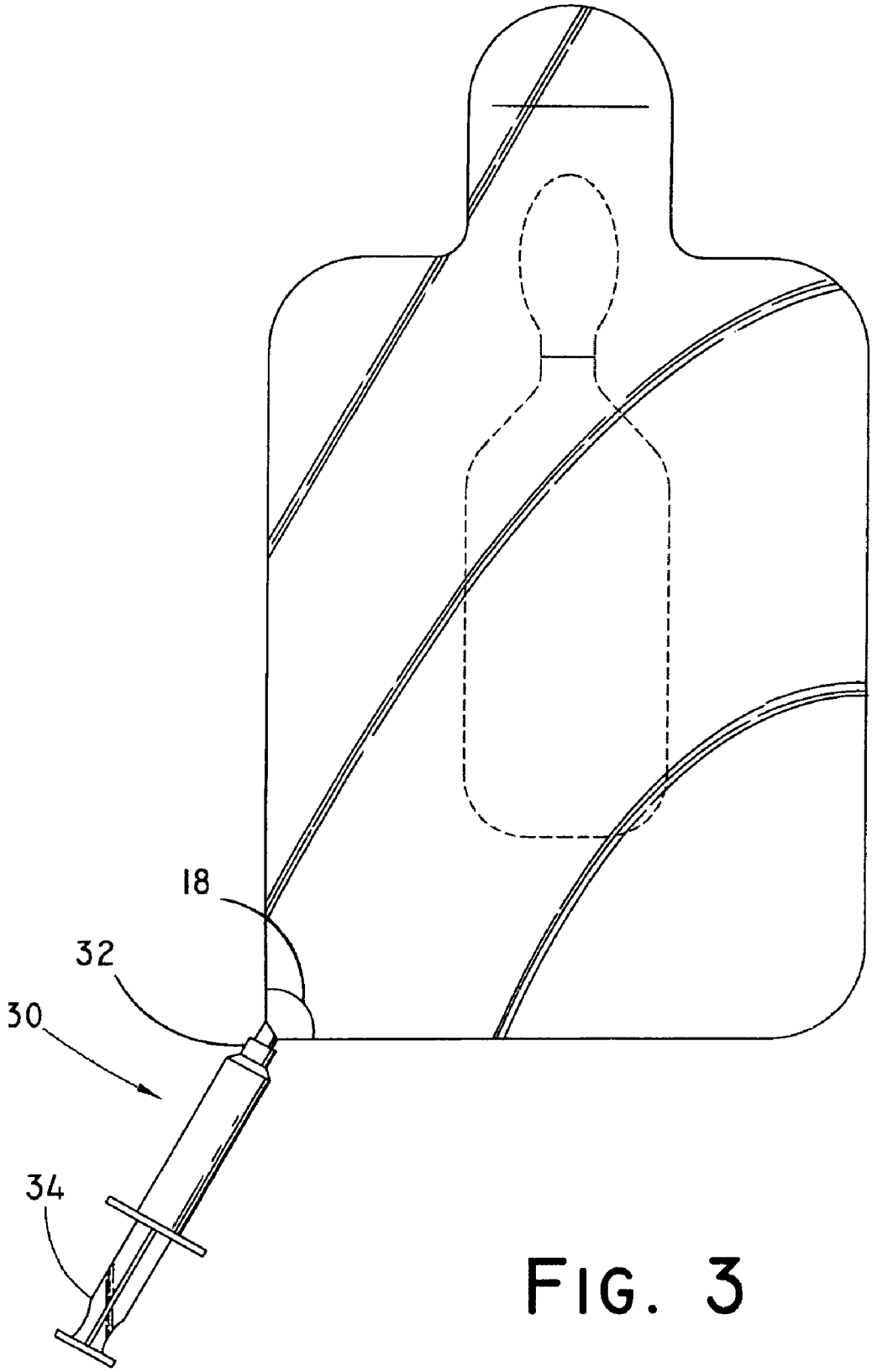
FIG. 3 is a view of the transfer bag as shown in FIG. 1 having a conduit attached, and wherein the container of FIG. 2 has been inserted into the transfer bag.

One example of a suitable conduit for receiving the hazardous substance from transfer bag 10 is a syringe 30, as shown in FIG. 3. In this embodiment, syringe 30 includes a mating luer lock connector 32, and a plunger 34. Syringes having luer lock connection mechanisms suitable for use in the inventive mixing system are commercially available from, e.g., VWR International, of West Chester, Pa. Particularly preferred syringes for use in mixing bone cement have a capacity of about 20 ml, although those skilled in the art will appreciate that syringes of larger, or smaller, size can be utilized, depending on the type and amount of powder, and the type and amount of liquid being transferred. Although a luer lock connection is utilized in FIG. 3 to mate transfer bag 10 and syringe 30, those skilled in the art will recognize that other conventional connector mechanisms could be substituted for the luer lock connection shown, as long as suitable mating connector mechanisms are provided on bag 10 and syringe 30 to form a substantially leak-free seal therebetween for transfer of the hazardous substance from transfer bag 10 to the conduit.

Figure 2:
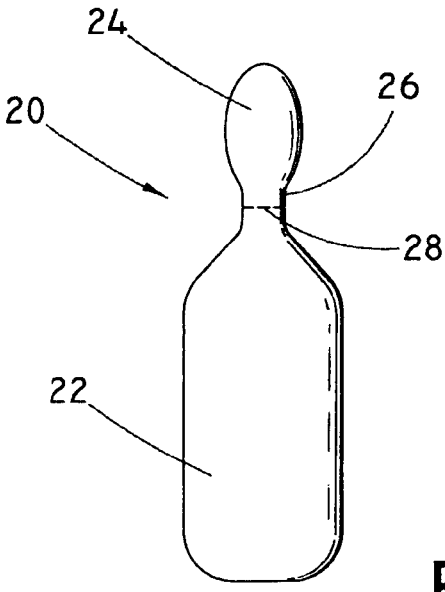
FIG. 2 shows one embodiment of a container for a hazardous substance that can be inserted into the transfer bag of FIG. 1.

The hazardous substance is initially provided in a suitable container, which container is sized to be received in the transfer bag. One example of a suitable container is a breakable glass ampoule, such as ampoule 20 shown in FIG. 2. In this embodiment, ampoule 20 includes a generally cylindrical main body portion 22 and a narrow tapered head portion 24. A reduced diameter neck portion 26 joins main body portion 22 and head portion 24. Preferably, neck portion 26 includes a scored line 28 to facilitate breakage of the ampoule, and to control the area of the ampoule where the breakage occurs. Breakable containers such as ampoule 20 are well known, and those of ordinary skill in the art can readily select a particular container, or ampoule, for a particular purpose.

Preferably transfer bag 10 and ampoule 20 are sized relative to each other such that a clinician can easily grasp body portion 22 and head portion 24 in separate hands when the ampoule is positioned inside transfer bag 10, as shown in FIG. 3. In this manner, ampoule 20 can be broken by simply snapping the ampoule along the scored line 28. FIG. 3 merely illustrates one example of suitable relative dimensions of bag 10 and ampoule 20, and those skilled in the art will appreciate that many suitable combinations can be made for a particular purpose. Although ampoule 20 is a preferred container for the hazardous substance, those skilled in the art will also appreciate that containers of other shapes and compositions may be utilized in a particular case, taking into consideration the type of hazardous substance to be housed in the container and the manner in which the hazardous substance is to be transferred to bag 10.

Figure 4:
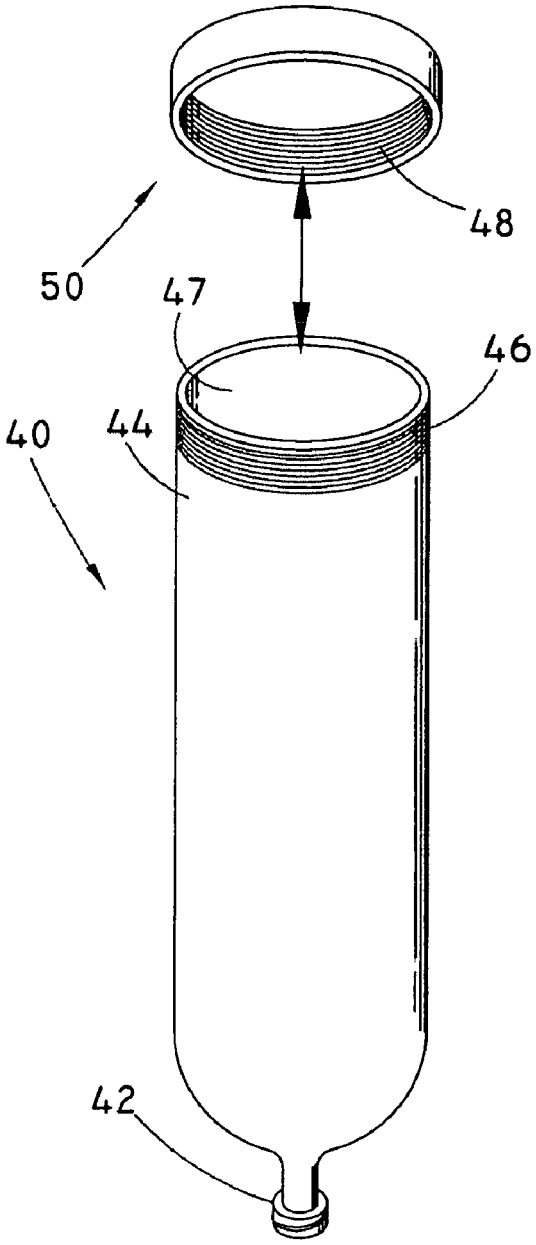
FIG. 4 illustrates a receptacle for use in mixing bone cement.

In a preferred embodiment, the mixing system of the present invention also includes a receptacle for receiving the hazardous substance from the syringe 30. One example of a suitable receptacle is shaker 40, as shown in FIG. 4. Shaker 40 comprises a generally cylindrical container having a luer connector 42 for receiving the hazardous substance from syringe 30. Connector 42 can be any suitable connector that is sized and shaped to mate with luer connector 32 of the syringe such that a substantially leak-free connection is established therebetween.

In the preferred embodiment shown, shaker 40 also includes external screw threads 46 at end portion 44. Screw threads 46 are sized and spaced to be threadably received by corresponding internal screw threads 48 on a lid 50. Lid 50 seals one end of shaker 40 and, additionally, provides a flat surface upon which shaker 40 may be positioned and maintained in an upright position if desired. Additionally, lid 50 provides an air-tight seal to prevent the escape of harmful fumes. Instead of screw threads, shaker 40 can alternatively be mounted on lid 50 in any conventional manner, such as by a snap-fit connection, or by a friction fit.

Although it is preferred to utilize a lid 50 in combination with the shaker 40, the use of a separate lid is optional. Generally, it is preferred to provide shaker 40 with a powder or other composition that is used to mix with the hazardous substance transferred therein. Opening 47, at an end of shaker 40, provides a convenient aperture to enable loading of shaker 40 with the powder or other composition. However, those skilled in the art will appreciate that shaker 40 can be loaded by any convenient means, and need not be loaded by way of opening 44 and removable lid 50.

Shaker 40 is preferably formed from a material that is substantially non-reactive to the hazardous substance to be received therein, and that has sufficient structural integrity to maintain its size and shape during any reaction that may occur therein. Preferably, shaker 40 is formed from a polymeric composition such as polyethylene, polypropylene, or polyethylene terephthalate (PET).

Figure 5:
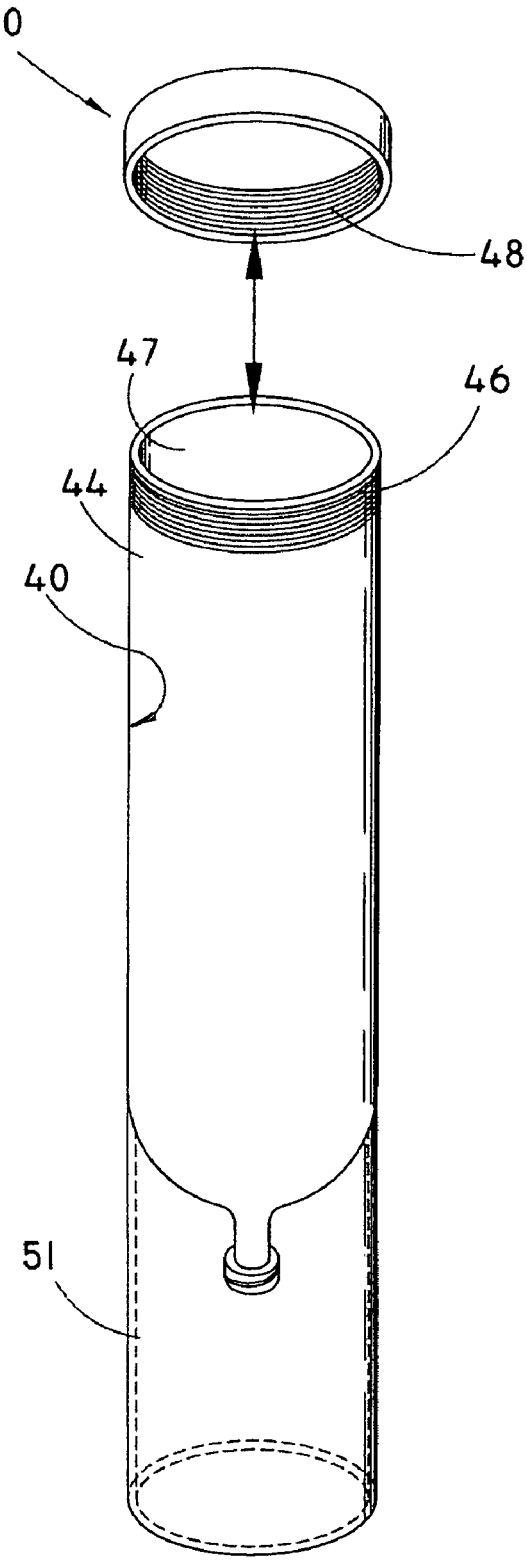
FIG. 5 illustrates an alternative embodiment of a receptacle for mixing bone cement, wherein the receptacle of FIG. 4 is enclosed in a sleeve that can be provided to stabilize the receptacle.

In another embodiment, shaker 40 can be provided with a base portion 51 that extends from the end of shaker 40 opposite opening 47. Base portion 51 can be easily formed during, e.g., extrusion or molding of shaker 40, and enables shaker 40 to be maintained an upright position, as shown in FIG. 5. As yet another alternative, shaker 40 can be formed to have a widened end portion that functions as a base. This portion can be provided at either axial end of the shaker. As still another alternative, base 51 can be provided as a separate sleeve that snugly fits over the cylindrical body of shaker 40. For convenience, sleeve 51 may be formed from the same compositions used to form shaker 40, or from any other suitable composition.

Use of the inventive mixing system for mixing a composition that includes at least one hazardous substance will now be described. In the following example, the hazardous substance is the liquid monomer MMA that is used in the preparation of bone cement. Initially, a glass ampoule 20 containing MMA is introduced through slit 14 into transfer bag 10. Commercially available ampoules that contain about 9.2 ml MMA are generally satisfactory for the intended use. The clinician seals the bag and then breaks open ampoule 20. Ampoule 20 may be conveniently broken by grasping body portion 22 and head portion 24 in separate hands, and snapping the ampoule open along score line 28 in conventional fashion. The contents of the ampoule are then allowed to drain from the ampoule into the lower portion of transfer bag 10.

A conduit for receiving the contents of ampoule 20 is mounted onto connector 12. In the embodiment of FIG. 3, the conduit is a syringe, although those skilled in the art will recognize that the conduit may be any compatible device that is sized and shaped to receive the MMA from the transfer bag for further processing. A syringe is particularly appropriate because the syringe can conveniently be used to aspirate the contents from the transfer bag in well-known fashion by drawing back on plunger 34. Once the liquid has been aspirated into syringe 30, the syringe is disconnected from the transfer bag. If desired, a commercially available luer cap can be placed on the transfer bag to limit residual vapor.

Connector 32 of syringe 30 is then connected to a spout of a suitable receptacle, such as shaker 40 shown in the drawings. Spout 42 is provided with a luer lock connector that mates with connector 32 of the syringe to provide a substantially leak-free connection. In this example, shaker 40 has been pre-loaded with about 20 grams of a powder composition comprising PMMA. The contents of the syringe are injected into shaker 40, and the liquid and powder composition are mixed, such as by shaking and/or stirring, to form a pliable mass. The mass later hardens to a wet cement-like consistency.

Following preparation of the bone cement as described, syringe 32 is disconnected from spout 42. At this time, a conventional bone cement applicator, such as an applicator gun or an application syringe, may be attached to spout 42. The bone cement may then be applied to the affected area of a patient in the usual manner.

Although the example provided above utilizes the mixing of the hazardous substance MMA with other ingredients to form bone cement, the mixing system of the present invention may also be utilized with other hazardous substances, and also in instances when more than one hazardous substance is to be mixed into a final composition. For example, additional hazardous substances can be added to receptacle 40 via one or more additional syringes or other transfer conduits in similar fashion. Similarly, more than one hazardous substance can be introduced into the same transfer bag, for later transfer to the conduit. Those skilled in the art will recognize that the type and amount of hazardous substances to be utilized must always be considered to evaluate the propriety of any such modifications.

Although the preferred embodiment described above utilized a conduit, such as syringe 30, for transferring the hazardous substance from bag 10 to receptacle 40, the presence of a separate conduit is not always required. Rather, in some instances, such as when aspiration of the contents of the bag is not considered necessary or desirable, connector 12 can be configured to mate with spout 42, so that the contents of bag 10 can be poured directly into receptacle 40.

The mixing system described above is effectively closed to the outer environment, and is safe and easy to use. Although preferred embodiments of the invention have been described, those skilled in the art will recognize that modifications may be made that are also within the scope of the invention. For example, the lid 50 can be removed after mixing the liquid and powder components, and a plunger can be inserted. Alternatively, the lid can be provided with a suitable plunger mechanism. In such case, the spout 42 can then be connected directly to a biopsy needle or other relevant transfer tube, which can be inserted directly into an area of intended use.

It is therefore intended that the foregoing detailed description be regarded as illustrative rather than limiting, and that it be understood that it is the following claims, including all equivalents, that are intended to define the spirit and scope of this invention.

The invention claimed is:

1. A mixing system for mixing a hazardous substance with one or more additional components to form a product, the mixing system comprising:

a bag, said bag being sized for receiving a container of said hazardous substance and structured for housing said hazardous substance from said container in a substantially leak-free manner, said bag including a bag connector;

a syringe, said syringe including a syringe connector configured to mate with the bag connector to form a substantially leak-free seal therebetween, said syringe sized and adapted for receiving said hazardous substance from said bag; and a receptacle, said receptacle including a receptacle connector configured to mate with said syringe connector to form a substantially leak-free seal therebetween, said receptacle sized for housing said one or more additional components and for receiving said hazardous substance from said syringe for mixing with the one or more additional components to form the product.

2. The mixing system of claim 1, wherein said bag comprises a filter member.

3. The mixing system of claim 2, wherein said bag comprises a sealing mechanism, said sealing mechanism being selectively sealable for allowing access into said bag.

4. The mixing system of claim 3, wherein said sealing mechanism comprises at least one of a rib and groove fastener, a hook and loop fastener, and a zipper.

5. The mixing system of claim 3, wherein said sealing mechanism comprises a rib and groove fastener.

6. The mixing system of claim 1, wherein said bag comprises a polymeric material selected from the group consisting of polyethylene, polyimide, silicone, polyester, polyetherimide, PVC, polyurethane, nylon, and copolymers thereof.

7. The mixing system of claim 1, wherein said syringe connector and bag connector comprise mating luer lock connectors.

8. The mixing system of claim 1, wherein said syringe connector and receptacle connector comprise mating luer lock connectors.

9. The mixing system of claim 1, wherein said receptacle further comprises a removable lid.

10. The mixing system of claim 1, wherein said receptacle further comprises a base portion.

11. A mixing system for mixing a hazardous substance with one or more additional components to form a product, the mixing system comprising:

a bag, said bag including a bag connector, said bag sized for receiving a container of said hazardous substance therein; and a receptacle for receiving said hazardous substance from said bag, said receptacle including a receptacle connector configured to mate with said bag connector to form a substantially leak-free seal therebetween, said receptacle sized for retaining said one or more additional components therein and for receiving said hazardous substance to form the product.

12. The mixing system of claim 11, wherein said bag comprises a filter member.

13. The mixing system of claim 11, wherein said bag comprises a sealing mechanism, said sealing mechanism comprising at least one of a rib and groove fastener, a hook and loop fastener, a zipper and an adhesive.

14. The mixing system of claim 12, wherein said bag comprises a polymeric material selected from the group consisting of polyethylene, polyimide, silicone, polyester, polyetherimide, PVC, polyurethane, nylon, and copolymers thereof, and said receptacle comprises a polymeric material selected from the group consisting of polyethylene, polypropylene and polyethylene terephthalate.

* * * * *